United States Patent [19]

Brown

[11] Patent Number: 4,555,696

[45] Date of Patent: Nov. 26, 1985

[54] PASSAGEWAY SELECTIVE DETECTOR MECHANISM AND SYSTEM

[76] Inventor: Donald G. Brown, 4609 Kellogg Ave., Cincinnati, Ohio 45226

[21] Appl. No.: 502,175

[22] Filed: Jun. 8, 1983

[51] Int. Cl.[4] ..... G08B 13/24

[52] U.S. Cl. ..... 340/551; 200/61.41; 200/86.5; 335/206; 340/572

[58] Field of Search ..... 340/551, 561, 552, 572, 340/568, 540; 200/86.5, 61.41, 61.93; 335/206

[56] References Cited

U.S. PATENT DOCUMENTS

| | | | |
|---|---|---|---|
| 2,187,928 | 1/1940 | Barcroft | 340/561 X |
| 3,423,674 | 1/1969 | Goldsmith et al. | 340/572 X |
| 3,577,136 | 5/1971 | Wolf | 340/572 |
| 3,596,024 | 7/1971 | Smith et al. | 200/86.5 |
| 3,854,131 | 12/1974 | Vanderheiden et al. | 335/206 X |
| 3,919,704 | 11/1975 | Williams et al. | 340/572 |
| 4,012,690 | 3/1977 | Heytow | 340/552 X |
| 4,095,214 | 6/1978 | Minasy | 340/552 |
| 4,135,184 | 1/1979 | Pruzick | 340/572 |
| 4,281,321 | 7/1981 | Narlow et al. | 340/572 |
| 4,336,519 | 6/1982 | Lebecque | 335/206 |
| 4,394,645 | 7/1983 | Humble et al. | 340/551 X |
| 4,430,645 | 2/1984 | Eskandry et al. | 340/572 |

*Primary Examiner*—Glen R. Swann, III
*Assistant Examiner*—Thomas J. Mullen, Jr.
*Attorney, Agent, or Firm*—Jacox & Meckstroth

[57] ABSTRACT

The passageway selective detector mechanism and system of this invention comprises a mat positionable within a passageway, such as a doorway, gateway, or the like. Imbedded within the mat are magnetically operable electric switches which are electrically connectable to an alarm or signal member and to a source of electrical energy. Thus, when any of the switches is operated, the alarm or signal member is energized. The mechanism and system includes magnetic elements associated with selective personnel for operation of at least one of the electric switches as the selective personnel travels over the mat. The magnetic element may comprise an inner sole within the shoe of the selective personnel to actuate an electric switch, which actuates the alarm or signal member as the selective personnel steps upon the mat. The magnetic element may also comprise a magnetic member carried by a wheelchair in which the selective personnel travels and which actuates an electric switch, which energizes an alarm or signal member as the selective personnel travels over the mat in a wheelchair.

12 Claims, 4 Drawing Figures

PASSAGEWAY SELECTIVE DETECTOR MECHANISM AND SYSTEM

BACKGROUND OF THE INVENTION

In various types of environments it is desirable to create a signal when certain persons travel through a passageway. For example, in a nursing home situation, it is desirable that a signal is created if a patient walks through a passageway which exits from the nursing home. Another situation in which a signal should be created occurs in a hostage or kidnap type of event in which a hostage or kidnapped person is forced to travel through a passageway to exit from a location of safety.

It is an object of this invention to provide a mechanism and a system by which a signal is created when selected personnel travel through a passageway.

It is another object of this invention to provide such a mechanism and system which can be employed with regard to a variety of passageways, such as doors, gates, etc.

It is another object of this invention to provide such a mechanism and system which may be unknown or unobservable to the selected personnel or which is unknown or unobservable to others involved in passage through the passageway.

It is another object of this invention to provide such a mechanism and system which can be constructed at relatively low costs.

Other objects and advantages of this invention reside in the construction of parts, the combination thereof, the method of production, and the mode of operation, as will become more apparent from the following description.

BRIEF DESCRIPTION OF THE INVENTION

The passageway selective detector mechanism and system of this invention comprises a mat which is positioned in a passageway and which includes switch means which are activated when selective personnel travel over the mat. The switch means is magnetically operated, and the selected personnel are provided with magnetic means which operate the switch means, and an alarm or signal is energized as the selected personnel travel over the mat. When persons other than the selected personnel travel over the mat, the switch means is not operated, and the alarm or signal is not energized.

DETAILED DESCRIPTION OF THE INVENTION

Figure 1:
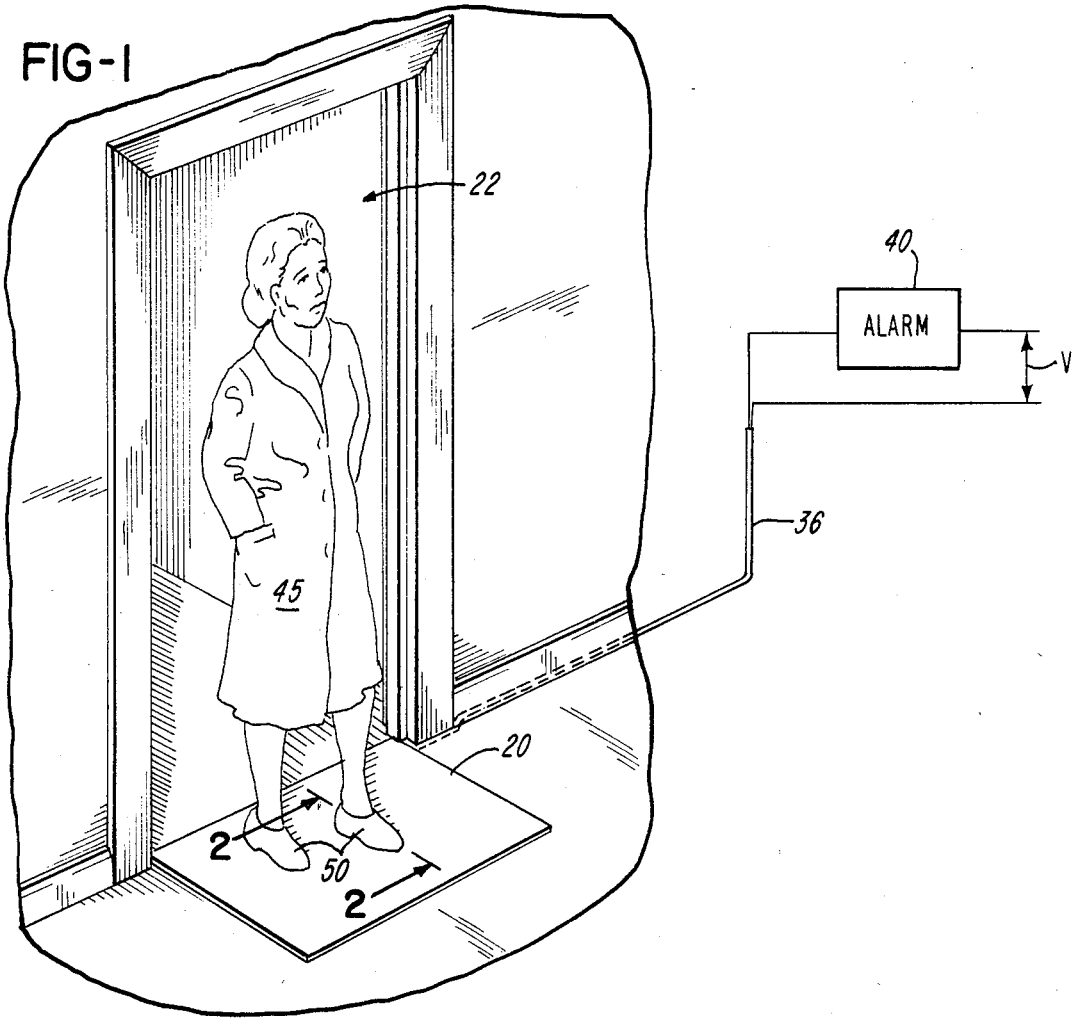
FIG. 1 is a perspective and diagrammatic view illustrating the mechanism and system of this invention.

The passageway selective detector mechanism and system of this invention comprises a mat 20 which is located in a passageway, such as a doorway 22, as shown in FIG. 1.

Figure 3:
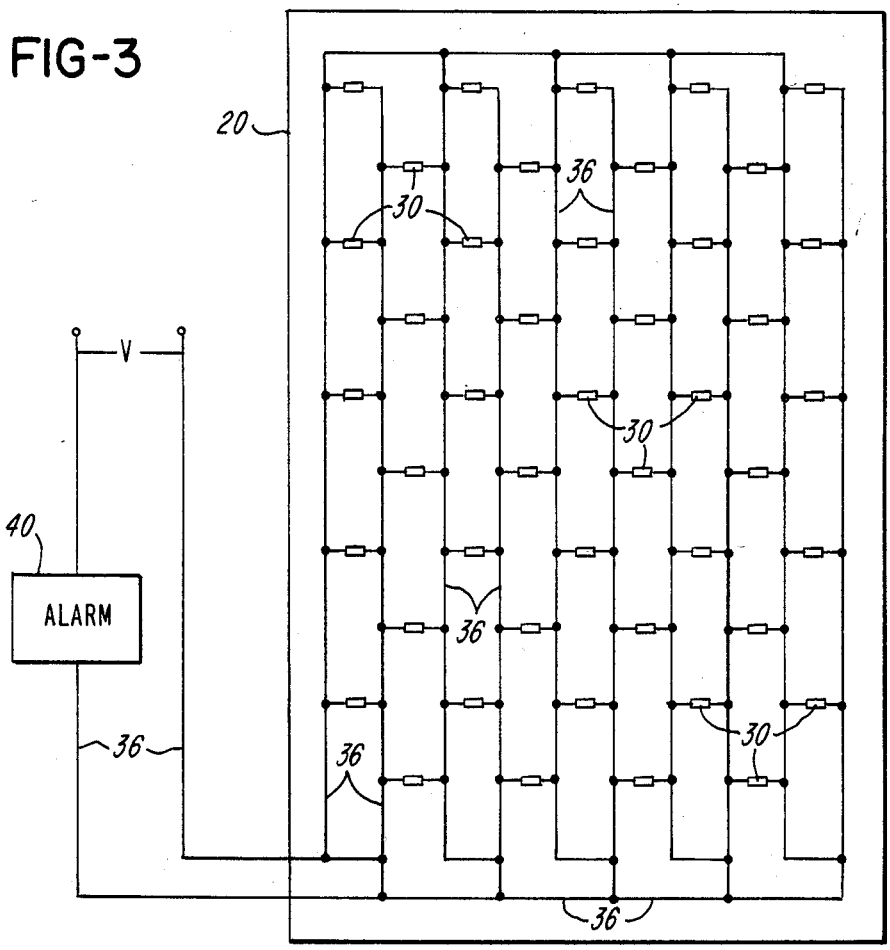
FIG. 3 is a diagrammatic view illustrating the switch arrangement within a mat of this invention and an alarm unit in association therewith.

Imbedded within the mat 20 is a plurality of magnetically operable electric switches 30, as illustrated in FIG. 3. Also as shown in FIG. 3 the switches 30 are connected together in parallel relationship by electric conductors 36. However, the switches 30 may be connected together in any other suitable relationship. Each of switches 30 is shown as being normally open. However, electric circuits and switches may be used in which normally-closed switches are employed. The electric conductors 36 are connected to a source of electrical energy "V" .

The electric conductors 36 also connect the switches 30 to an alarm 40, which may be audible, visual, or both, and which may be located at any suitable or desired location. Therefore, in the electrical circuitry shown, when any of the switches 30 is closed, the alary 40 is energized.

Figure 2:
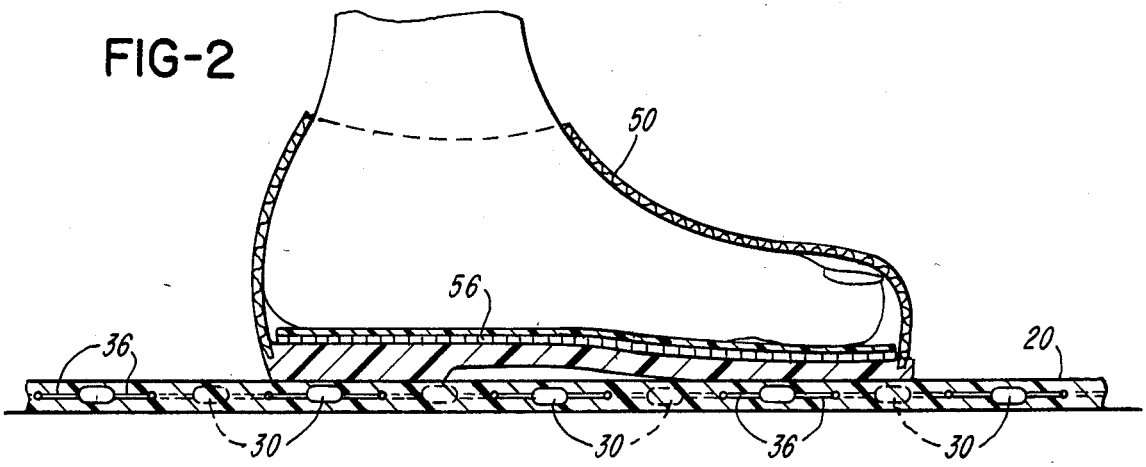
FIG. 2 is an enlarged sectional view taken substantially on line 2—2 of FIG. 1.

Due to the fact that each of the switches 30 is magnetically operated, it is necessary to have magnetic means for operation of the switches 30. FIG. 1 shows a person 45 having shoes 50 positioned upon the mat 20. As illustrated in FIG. 2, each shoe 50 of the person 45 is provided with a flexible inner sole 56 of magnetic material. Thus, when the person 45 places one or both shoes 50 upon the mat 20, at least one of the switches 30 is magnetically operated, and the alarm 40 is energized.

Figure 4:
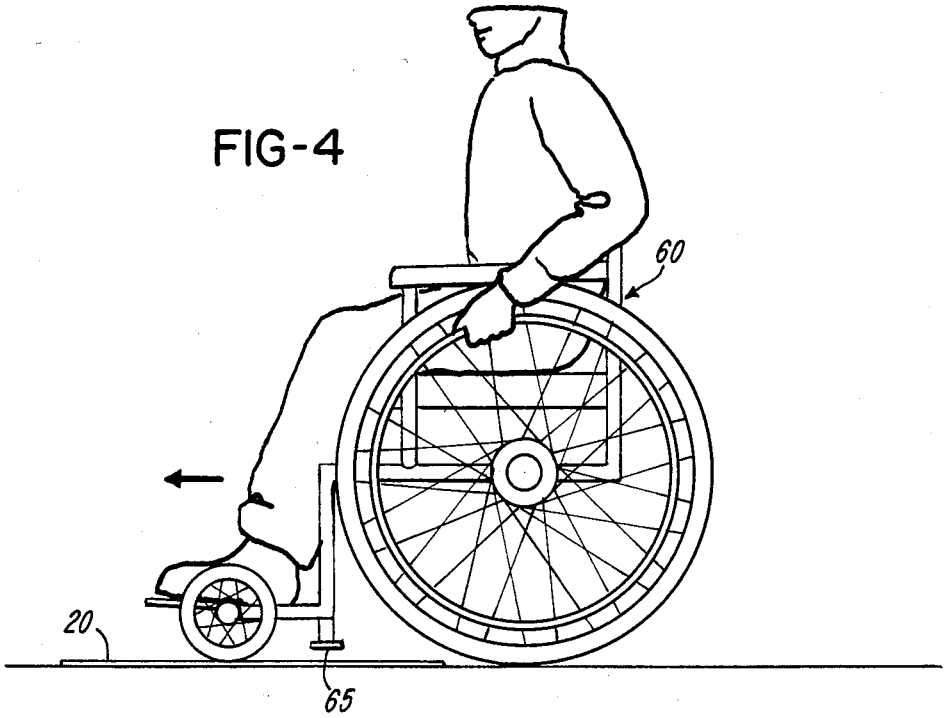
FIG. 4 is a side elevational view illustrating a modification in the magnetic means of the mechanism and system of this invention.

FIG. 4 shows a wheelchair 60 to which is attached a magnet 65 at the lower portion of the wheelchair 60. When the wheelchair 60 travels over the mat 20, the magnet 65 actuates one or more of the switches 30 within the mat 20, and the alarm 40 is energized.

Thus, it is understood that the detector mechanism and system of this invention is selective. Only persons who have magnetic means associated therewith cause energization of the alarm 40 when traveling through the passageway 22. Persons who do not have magnetic means associated therewith do not cause energization of the alarm 40 as they travel through the passageway 22.

Although the preferred embodiments of the passageway selective detector mechanism and system of this invention have been described, it will be understood that within the purview of this invention various changes may be made in the form, details, proportion and arrangement of parts, the combination thereof, and the mode of operation, when generally stated consist in a mechanism and system within the scope of the appended claims.

The invention having thus been described, the following is claimed:

1. Passageway selective detector mechanism comprising a mat for location in a passageway, the mat including a plurality of magnetically operable electric switches, alarm means, electric circuit means joined to the electric switches and to the alarm means and adapted to be joined to a source of electrical energy for energization of the alarm means by magnetic means positioned adjacent the mat.

2. The mechanism of claim 1 which includes a shoe and magnetic means carried by the shoe, so that a person wearing the shoe operates at least one of the electric switches when the person steps upon the mat, and thus the alarm means is energized.

3. The mechanism of claim 1 which includes a wheelchair and magnetic means carried by the wheelchair, so that when the wheelchair is positioned adjacent the mat at least one of the electric switches is operated and the alarm means is energized.

4. The mechanism of claim 1 which includes magnetic means adapted to travel with a person for operation of at least one of the electric switches as the person travels adjacent the mat.

5. The mechanism of claim 1 in which the electric switches are normally open and are joined to the electric circuit in parallel electrical relationship.

6. Passageway selective personnel detector mechanism comprising: a mat-like member positionable within a passageway and adapted to support a person traveling through the passageway, a plurality of magnetically operable switch members imbedded within the mat-like member, magnetic means associated with selective personnel for actuation of at least one of the switch members as selective personnel travel over the mat-like member.

7. The selective personnel detector mechanism of claim 6 in which the selective personnel wear shoes and in which at least one shoe includes a magnetic member therewithin for operation of at least one of the switch members as the selective personnel travels over the mat-like member.

8. The selective personnel detector mechanism of claim 6 in which the selective personnel wear shoes and in which at least one of the shoes includes an inner sole of magnetic material for operation of at least one switch member as the selective personnel steps upon the mat-like member.

9. The selective personnel detector mechanism of claim 6 in which the selective personnel travels in a wheelchair and in which the wheelchair includes a magnetic element which operates at least one of the switch members as the wheelchair travels over the mat-like member.

10. Discriminating detector mechanism for sensing the travel of selected personnel through a passageway, comprising: a mat-like member positionable within the passageway and adapted to support a person traveling through the passageway, a plurality of magnetically operable electric switches embedded within the mat-like member and positioned at closely spaced-apart locations throughout the mat-like member, an electrically operable alarm, electrical conductors connected to the magnetically operable electric switches and to the electrically operable alarm, and magnetic members carried by selected personnel for actuation of at least one of the magnetically operable electric switches as selected personnel travel over the mat-like member.

11. The discriminating detector mechanism of claim 10 in which the magnetically operable electric switches are electrically connected together in an electric parallel circuit.

12. The method of detecting the travel of selected personnel through a passageway comprising: positioning within the passageway in closely spaced-apart relationship a plurality of magnetically operable electric switches which are electrically connected together in electrical parallel relationship, connecting the magnetically operable electric switches to an electrically operable alarm, equipping each of the selected personnel with a magnetic device so that when any of the selected personnel travels through the passageway, at least one of the magnetically operable electric switches is operated and the electrically operable alarm is energized.

* * * * *